US011906251B2

(12) United States Patent
Schoonen

(10) Patent No.: US 11,906,251 B2
(45) Date of Patent: Feb. 20, 2024

(54) FILLING FOR HEAT EXCHANGER

(71) Applicant: W. Schoonen Beheer B.V., Nuenen (NL)

(72) Inventor: Wilhelmus Franciskus Schoonen, Nuenen (NL)

(73) Assignee: W. Schoonen Beheer B.V., Nuenen (NL)

( * ) Notice: Subject to any disclaimer, the term of this patent is extended or adjusted under 35 U.S.C. 154(b) by 247 days.

(21) Appl. No.: 17/258,460

(22) PCT Filed: Jul. 2, 2019

(86) PCT No.: PCT/EP2019/067777
§ 371 (c)(1),
(2) Date: Jan. 7, 2021

(87) PCT Pub. No.: WO2020/011605
PCT Pub. Date: Jan. 16, 2020

(65) Prior Publication Data

US 2021/0278150 A1 Sep. 9, 2021

(30) Foreign Application Priority Data

Jul. 9, 2018 (EP) ..... 18182532
Aug. 1, 2018 (EP) ..... 18186877

(51) Int. Cl.
*F28F 13/00* (2006.01)
*F28D 9/00* (2006.01)
*F28D 21/00* (2006.01)

(52) U.S. Cl.
CPC ..... *F28F 13/003* (2013.01); *F28D 9/0056* (2013.01); *F28D 2021/007* (2013.01); *F28D 2021/0071* (2013.01)

(58) Field of Classification Search
CPC ..... F28F 13/003; F28D 9/0056; F28D 2021/007; F28D 2021/0071
(Continued)

(56) References Cited

U.S. PATENT DOCUMENTS 3,732,919 A 5/1973 Wilson
3,789,885 A 2/1974 Wilson
(Continued)

FOREIGN PATENT DOCUMENTS

EP 2937657 10/2015
EP 2937657 A1 * 10/2015 ..... F25B 39/00
(Continued)

OTHER PUBLICATIONS

Yashoda: "Difference between POM-H and POM-C", https://www.differencebetween.com/difference-between-pom-h-and-vs-pom-c/.

*Primary Examiner* — Tho V Duong
*Assistant Examiner* — Raheena R Malik
(74) *Attorney, Agent, or Firm* — N.V. Nederlandsch Octrooibureau

(57) ABSTRACT

A heat exchanger for a heat pump comprises a chamber (1) for a working fluid. A wall (2) provides for heat exchange between the working fluid in the chamber and a substance in a space (6) on the opposite side of the wall. Said chamber (1) comprises a structure (3) of a filling material (4) that is substantially non-absorbent with respect to the working fluid. Said structure (3) defines a plurality of channels (5) for the working fluid. Said channels (5) are at least partly bound by the wall (2) separating the chamber (1) from the space (6). Said channels (5) provide passage for the working fluid from an inlet (7) of the chamber (1) to an outlet (8) of the chamber.

14 Claims, 8 Drawing Sheets

(58) Field of Classification Search
USPC ..... 165/166
See application file for complete search history.

(56) References Cited

U.S. PATENT DOCUMENTS 6,050,101 A * 4/2000 Liu ..... F28F 13/003 62/305
6,119,457 A * 9/2000 Kawamura ..... F02B 41/00 165/907
6,131,650 A * 10/2000 North ..... F28F 13/003 257/E23.098
6,142,222 A * 11/2000 Kang ..... F28F 13/003 165/151
6,405,792 B1 * 6/2002 Rosenfeld ..... F28F 13/003 257/E23.098
6,410,160 B1 * 6/2002 Landin ..... B22F 3/1007 264/662
6,565,556 B1 * 5/2003 Korpan ..... A61B 18/02 606/23
2012/0216563 A1 * 8/2012 Braunschweig ..... F28F 13/003 62/515
2015/0260460 A1 * 9/2015 Ito ..... F28D 9/005 165/166
2017/0045275 A1 * 2/2017 Schoonen ..... F28F 27/02
2018/0328671 A1 * 11/2018 Schoonen ..... F28D 7/024
2019/0032982 A1 * 1/2019 Schoonen ..... F25B 49/027
2019/0041109 A1 * 2/2019 Schoonen ..... F25B 41/34
2021/0278150 A1 * 9/2021 Schoonen ..... F28F 13/003

FOREIGN PATENT DOCUMENTS

JP H05312486 11/1993
JP 2000088490 A 3/2000

* cited by examiner

FILLING FOR HEAT EXCHANGER

FIELD OF THE INVENTION

The invention relates to a heat exchanger.

BACKGROUND OF THE INVENTION

Heat exchangers are widely used to perform refrigeration or heating functions.

Moreover, refrigeration systems may include heat exchangers as a condenser and/or as a vaporizer of a refrigerant liquid. A refrigeration cycle may include a condenser, a vaporizer, and a compressor, forming a closed circuit for the refrigerant. These components typically require a certain volume of refrigerant to achieve a certain performance. It may be advantageous to limit the amount of refrigerant necessary to obtain certain cooling power. More generally, there would be a need for an improved heat exchanger.

EP 2 937 657 discloses a vessel for containing a refrigerant comprising an inner wall and an outer wall arranged concentrically and having an inner space bounded by the inner wall and outer wall, an inlet and an outlet for transport of refrigerant into and out of the inner space; a tube inside the inner space arranged around the inner wall; an input tube fluidly connected to the inner space and arranged to allow flow of the refrigerant through the input tube into the inner space; an output tube connected to the inner space and arranged to allow flow of the refrigerant out of the inner space into the output tube; a compressor arranged to receive the refrigerant from the output tube and to compress the refrigerant; and a condenser arranged to receive the compressed refrigerant fluid from the compressor, to condense the refrigerant, and to forward the compressed refrigerant into the input tube.

Although the amount of refrigerant may be reduced by employing such a vessel, it would be advantageous to further reduce the amount of refrigerant, or to reduce the amount of refrigerant in another kind of vaporizer or compressor.

SUMMARY OF THE INVENTION

It would be advantageous to provide an improved heat exchanger. To address this need, a heat exchanger is provided for a heat pump, comprising a chamber for a working fluid; and a wall for heat exchange between the working fluid in the chamber and a substance in a space on the opposite side of the wall, said chamber comprising a structure of a filling material that is substantially non-absorbent with respect to the working fluid, said structure defining a plurality of channels for the working fluid, said channels at least partly being bound by the wall separating the chamber from the space, said channels providing passage for the working fluid from an inlet of the chamber to an outlet of the chamber.

The filling material takes up some of the space of the heat exchanger, so that less working fluid is necessary to fill the chamber of the heat exchanger. However, the heat exchange through the wall still takes place, in particular where the channels are bound by the wall. This way, the amount of working material may be greatly reduced, while still providing sufficient space for the heat exchange and optional evaporation or condensation to take place inside the channels. For example, a random structure of channels is possible that fills up a substantial portion of the chamber and that is still an open structure allowing the passage of the working fluid.

The structure may be made up of a plurality of grains. This provides such a random structure of filling material. Moreover, it is easy to manufacture because the grains adjust to any shape of chamber.

Preferably, the channels of the structure do not have dead ends. This may improve performance, because dead ends may prevent or slow down a portion of the working fluid from moving from inlet to outlet.

The material may comprise sand or quartz or grit. Such a material may have suitable characteristics in terms of durability, non-absorbence and the working fluid may not stick to the surface of the material. Moreover, these types of material have a certain heat capacity, allowing them to store the heat or coldness, which may improve the quality of the heat exchange.

The material may comprise a polymer, for example a thermoplastic polymer, such as a polyoxymethylene copolymer, POM-C, or a polyoxymethylene homopolymer, POM-H. Such a material may have suitable characteristics in terms of durability, non-absorbence, and the working fluid may not stick to the surface of the material. Moreover, this type of material may have a relatively low heat capacity, so that the heat exchange is more directly controlled by the temperature and the velocity of flow of the working fluid. The material may comprise polymer grains. Alternatively, a rigid open connected structure with the channels may be provided.

The material may be substantially non-absorbent with respect to oil. This may be advantageous, since the working fluid may be contaminated with some oil used for e.g. a compressor.

The grains may have an average diameter of between 0.3 millimeter and 1 millimeter, preferably between 0.4 millimeter and 0.7 millimeter, preferably about 0.5 millimeter. The dimensions of the grains may depend on the specific application. The given ranges are suitable for a wide range of applications.

The channels may have a diameter of generally less than 1 millimeter in cross section. The dimensions of the channels may depend on the specific application. The given ranges are suitable for a wide range of applications.

The filling material may fill up between 30% and 70% of the volume of the chamber, preferably 55 to 60%. This way, the amount of working material is greatly reduced, while still providing sufficient space for the heat exchange and optional evaporation or condensation to take place inside the channels.

The heat exchanger may comprise an evaporator or a condenser. This allows phase change of the working fluid inside the heat exchanger without using much working fluid.

The heat exchanger may further comprise a compressor, an expansion valve, and the other of evaporator and condenser, to form a vapor-compression cycle. Optionally, both the evaporator and the condenser may be filled with the filling material. In that case, the filling material of the evaporator may be the same as that of the condenser, or they may both have a different filling material and/or a different structure. Alternatively, only the evaporator may have the filling and not the condensor. Alternatively, only the condensor may have the filling and not the evaporator. Independently from this decision, it is also possible to fill any channels for the working fluid, the channels fluidly connecting the components of the vapor-compression cycle, with the filling material in a similar way.

Said other of evaporator and condenser may comprise:

a second chamber for the working fluid, a second wall for heat exchange between the working fluid in the second chamber and a second substance in a second space on the opposite side of the second wall;

said second chamber comprising a second structure of a second filling material that is substantially non-absorbent with respect to the working fluid, said second structure defining a plurality of second channels for the working fluid, said second channels at least partly being bound by the second wall separating the second chamber from the second space, said second channels providing passage for the working fluid from an inlet of the second chamber to an outlet of the second chamber.

According to another aspect of the invention, a method of heat exchange is provided. The method comprises:

pumping a working fluid through channels of a chamber, causing the working fluid to interact thermodynamically with a wall for heat exchange between the working fluid in the chamber and a substance in a space on the opposite side of the wall, said chamber comprising a structure of a filling material that is substantially non-absorbent with respect to the working fluid, said structure defining a plurality of channels for the working fluid, said channels at least partly being bound by the wall separating the chamber from the space, wherein the working fluid flows from an inlet of the chamber to an outlet of the chamber through the channels.

The person skilled in the art will understand that the features described above may be combined in any way deemed useful. Moreover, modifications and variations described in respect of the apparatus may likewise be applied to the method, and modifications and variations described in respect of the method may likewise be applied to the apparatus.

BRIEF DESCRIPTION OF THE DRAWINGS

In the following, aspects of the invention will be elucidated by means of examples, with reference to the drawings. The drawings are diagrammatic and may not be drawn to scale. Throughout the drawings, similar items are identified with the same reference numerals.

DETAILED DESCRIPTION OF EMBODIMENTS

Certain exemplary embodiments will be described in greater detail, with reference to the accompanying drawings.

The matters disclosed in the description, such as detailed construction and elements, are provided to assist in a comprehensive understanding of the exemplary embodiments. Accordingly, it is apparent that the exemplary embodiments can be carried out without those specifically defined matters. Also, well-known operations or structures are not described in detail, since they would obscure the description with unnecessary detail. In the following, example implementations will be described in more detail with reference to the drawings. However, it will be understood that the details described herein are only provided as examples to aid an understanding of the invention and not to limit the scope the disclosure. The skilled person will be able to find alternative embodiments which are within the scope and spirit of the present invention as defined by the appended claims and their equivalents.

Figure 1:
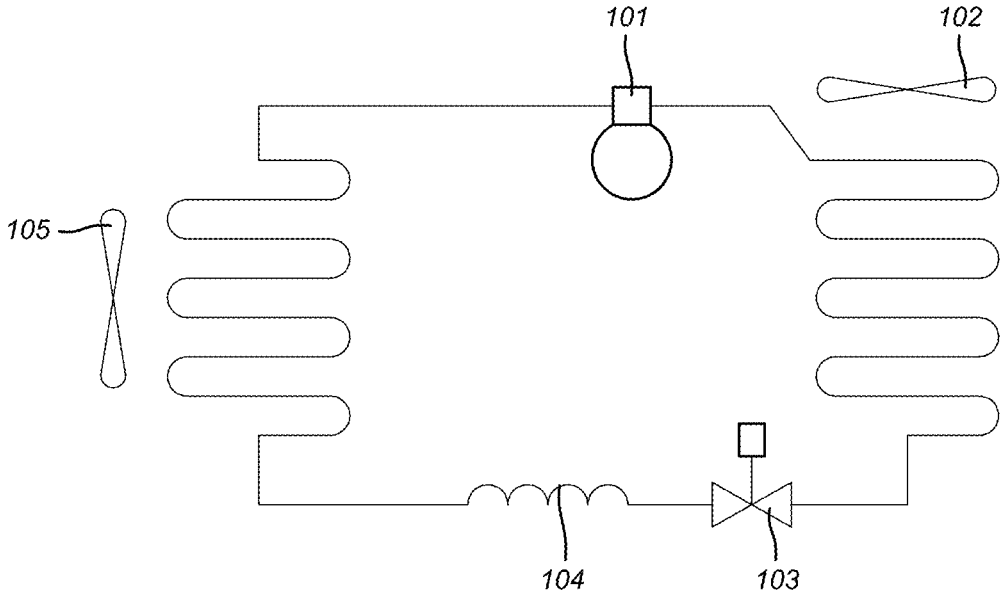
FIG. 1 shows a diagram of a heat pump.

FIG. 1 shows a diagram of a cooling system capable of circulating a working fluid in a heat pump, which may be based on a vapor-compression cycle, such as a refrigeration cycle. The cooling system comprises a compressor 101, a condenser 102, a valve 103, an expansion device 104, and an evaporator 105. These components 101, 102, 103, 104, 105 are fluidly connected to form the refrigeration cycle. Many different implementations of the compressor 101, condenser 102, valve 103, expansion device 104, and evaporator 105 are known in the art. For example, the valve 103 and the expansion device 104 may be combined by means of an expansion valve. Some aspects of the invention relate to the evaporator 105, which may be included in such a refrigeration cycle of a cooling system. In the following, the evaporator 105 will be described in greater detail. However, features of the invention may also be applied to the condenser 102 and/or to fluid connections between the components of the heat pump.

Figure 2A:
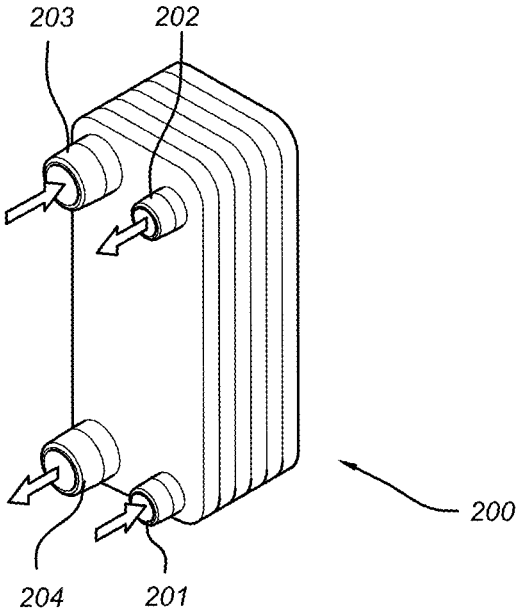
FIG. 2A shows a perspective view of a plate heat exchanger.
Figure 2B:
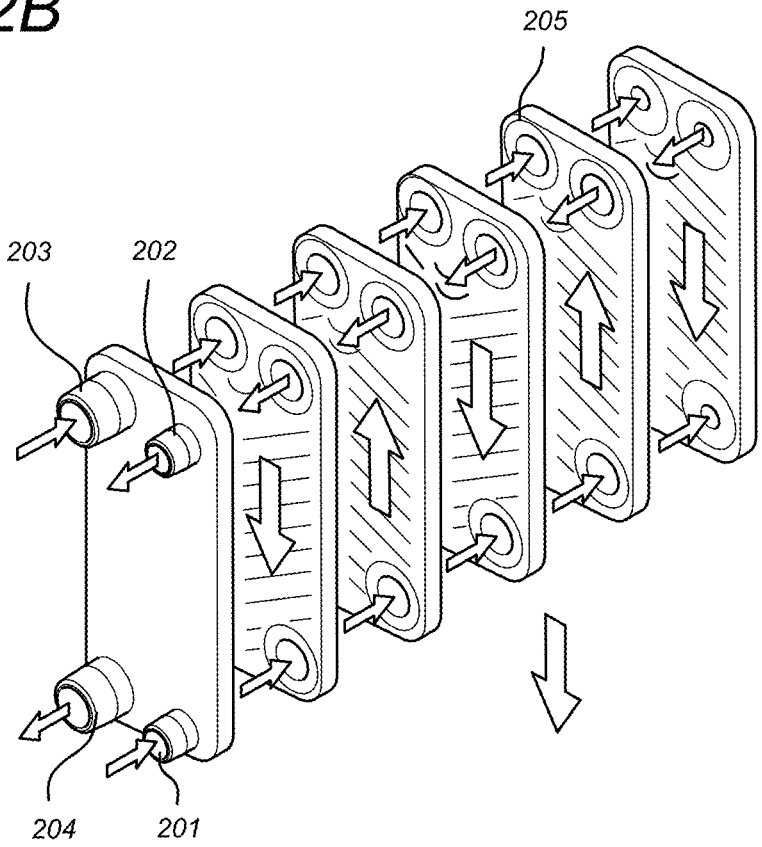
FIG. 2B shows a worked open perspective view of the heat exchanger of FIG. 2A.

FIG. 2A shows a perspective view of a heat exchanger 200. The example shown in FIG. 2A is a plate heat exchanger. The plate heat exchanger 200 has an inlet 201 and an outlet 202 for a working fluid, and an inlet 203 and an outlet 204 for a fluid to be cooled. FIG. 2B shows a worked open perspective view of the plate heat exchanger 200. As shown the plate evaporator 200 comprises a sequence of plates 205. In between the plates 205 there is alternately a chamber for working fluid or a space for a fluid to be cooled or warmed up. In case the heat exchanger 200 is an evaporator 105, the space is for a fluid to be cooled. In case the heat exchanger is a condenser 102, the space is for a fluid to be warmed up.

Figure 3:
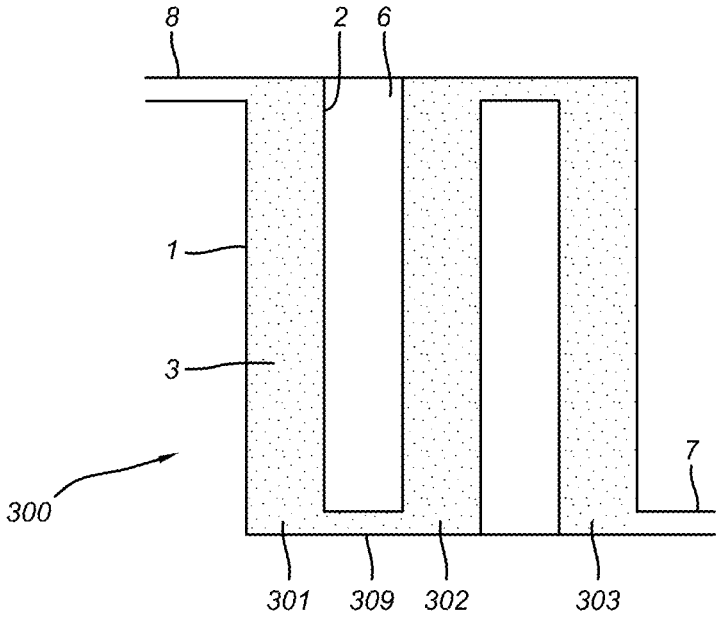
FIG. 3 shows a simplified cross section of a plate heat exchanger.

FIG. 3 shows a diagram of a cross section of a heat exchanger 300. Heat exchanger 300 is a simplified and diagrammatic representation of plate heat exchanger 200. The cross section is taken through the central axes of the inlet 201 and outlet 202 for the working fluid. The heat exchanger has a chamber 1 for a working fluid, and a space 6 for a substance to be processed (e.g. heat is to be extracted from the substance or heat is to be delivered to the substance). The chamber 3 may be separated from the space 6 by one or more walls 2. The chamber 3 may comprise a sequence of subchambers 301, 302, 303 that may be connected by fluid connections 309, such as tubes. The wall 2 is designed to allow heat exchange between the working fluid in the chamber 3 and the substance in the space 6 on the opposite side of the wall 2. For example the wall 2 may be made of a material, such as a metal, that allows easy transfer of heat. The chamber 1 for the working fluid comprises a structure 3 to fill up the chamber 1 partly with a filling material 4 that is substantially non-absorbent with respect to the working fluid.

Figure 4:
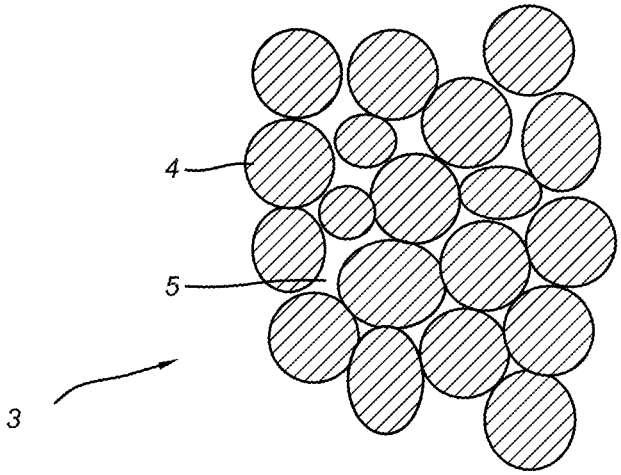
FIG. 4 shows a sketch of a structure containing a filling material.

FIG. 4 illustrates a diagrammatic illustration of a filling structure 3 providing randomly distributed filling material 4, leaving open randomly distributed channels 5. That is, the working fluid will flow through a plurality of channels 5 left open by the filling material 4. The channels 5 allow the working fluid to interact with the wall 2 to exchange heat with the substance in the space 6 on the opposite side of the wall 2. The channels 5 provide a passage for the working fluid from the inlet 7 of the chamber 1 to the outlet 8 of the chamber 1.

Although FIG. 4 shows randomly distributed channels, it will be understood that the channels may also have a non-random distribution, such as e.g. straight channels with junctions in an orderly fashion. Any shape of structure may be created by means of, for example, 3D printing. Alternatively, the structure may consist of loose grains. Such loose grains may typically create randomly distributed channels. Preferably the channels 5 do not have any dead ends. Dead ends may reduce the efficiency of the heat exchanger, because dead ends may partly prevent the working fluid to flow quickly towards the outlet after having exchanged heat with the substance.

In case the filling material 3 contains grains, the grains may have an average diameter of between 0.3 millimeter and 1 millimeter, preferably between 0.4 millimeter and 0.7 millimeter, preferably about 0.5 millimeter. In any case, the maximum distance between adjacent channels may be between 0.3 millimeter and 1 millimeter, preferably between 0.4 millimeter and 0.7 millimeter, preferably about 0.5 millimeter.

For example, the channels (5) may have a diameter of generally less than 1 millimeter in cross section.

The filling material 4 may fill up between 30% and 70% of the volume of the structure 3, preferably 55 to 60, and the channels (5) take up substantially the remaining portion of the volume of the structure 3. If the chamber 1 is filled entirely with the structure 3, the filling material and the channels take up a corresponding portion of the chamber 1.

Examples of the structure 3 and material 4 include any porous material, sponge, polymer grains, polymer structure with holes defining channels, crystal grains, sand, quartz. Suitable polymers include thermoplastic polymers, such as polyoxymethylene copolymer, POM-C, and polyoxymethylene homopolymer, POM-H. Preferably, the material 4 is substantially non-absorbent with respect to oil, because the working fluid may be mixed with some oil used to smear the compressor 101.

Figure 5:
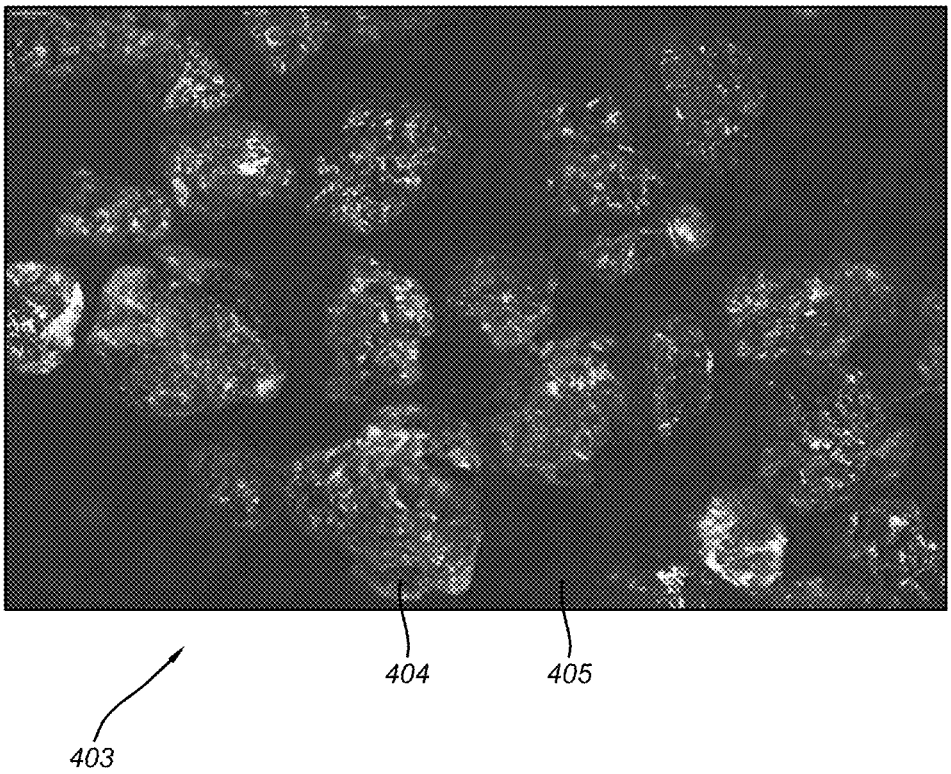
FIG. 5 shows a microscopic photograph of a filling material.

FIG. 5 shows a photograph of microscopically enlarged grit 403, with quartz grains 404 leaving open channels 405 between the grains 404.

Figure 6:
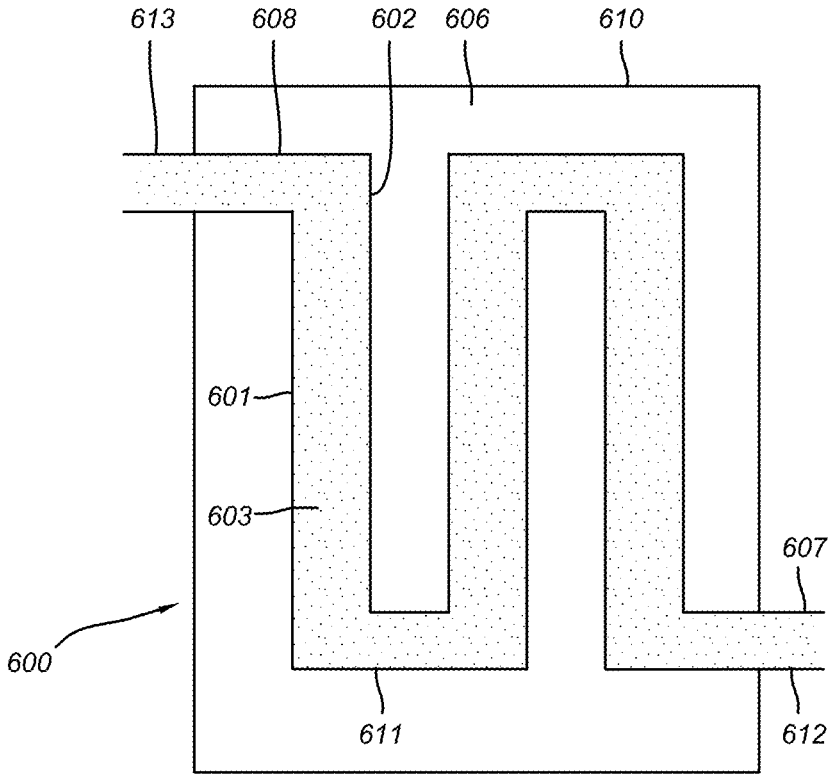
FIG. 6 shows a simplified diagram of a cross section of a heat exchanger based on tubes for working fluid.

FIG. 6 shows an alternative construction of a heat exchanger 600 with a vessel 610 that provides a space 606 for a substance, and a tube 611 having inlet 607 and outlet 608. The interior of the tube 611 is a chamber 601 for the working fluid. At least part of the chamber 601 is filled with a structure 603 with filling material 4 and channels 5 similar to the structure 3 shown in FIG. 3 and FIG. 4. In operation the working fluid flows through the channels 5 of the structure 603 from the inlet 607 to the outlet 608 of the chamber 601. As illustrated the structure 603 may also fill at least part of channels 612, 613 for the working fluid outside of the heat exhanger 600.

Figure 7:
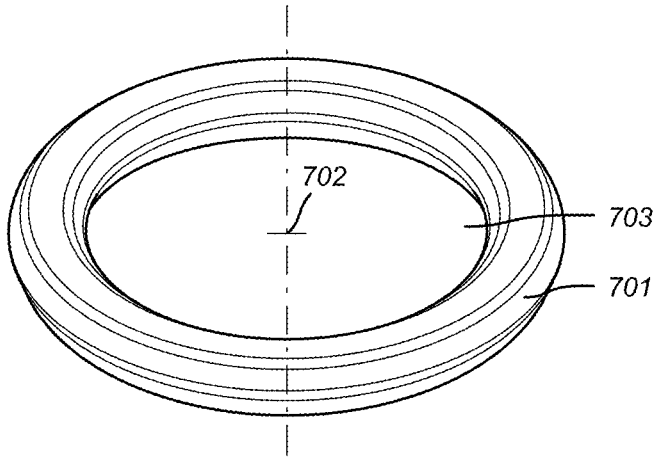
FIG. 7 shows a perspective view of an annular heat exchanger.
Figure 9:
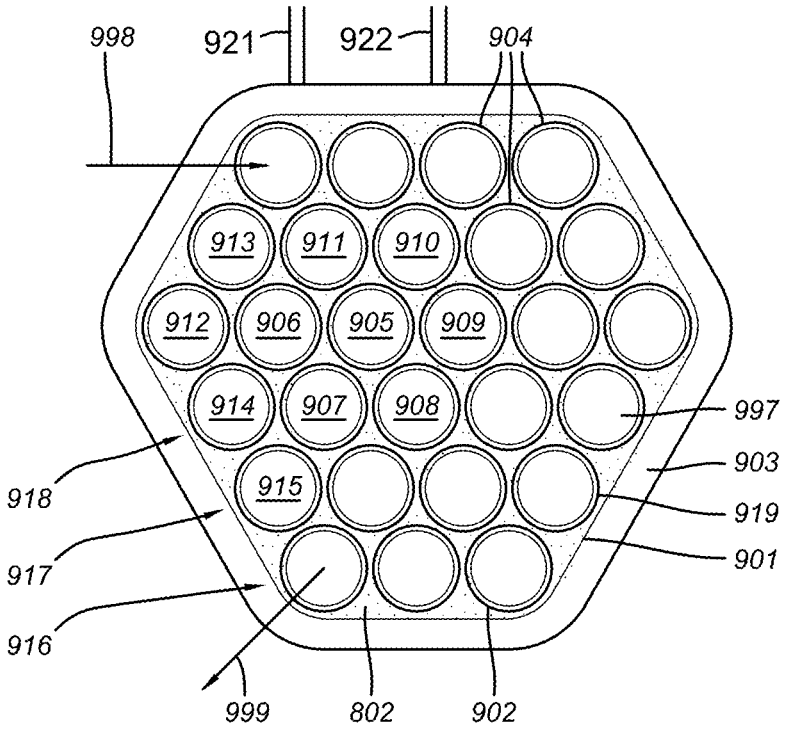
FIG. 9 shows a cross section of a part of the annular heat exchanger.

FIG. 7 shows a perspective view of a vessel 701 that can take the role of the evaporator 105 in a refrigeration cycle. The vessel 701 contains a chamber 802, and the chamber 802 contains tubing 801. In this example, the vessel has a toroid shape. The illustrated toroid is a toroid generated by revolving a planar hexagon 901 (see FIG. 9) about an axis (loosely drawn at numeral 702) external to that hexagon 901, which axis is parallel to the plane of the hexagon 901 and does not intersect the hexagon. It will be understood that the hexagon may be replaced by other shapes. The hexagon 901 is illustrated in FIG. 9. As shown in FIG. 9, the hexagon may have rounded corners. The rounding of a corner of the hexagon 901 may follow the outline of a tube portion 902.

Shown in FIG. 9 is the tube portion 998 connected to one end of tube portion 997 to enable fluid to flow through tube portion 998 into tube portion 997. Also shown is tube portion 999, which is connected to another end of tube portion 997 to enable fluid to flow from tube portion 997 into tube portion 999. It is noted that the flow of fluid may be reversed, so that fluid flows from tube portion 999 into tube portion 997 and then into tube portion 998.

Figure 8:
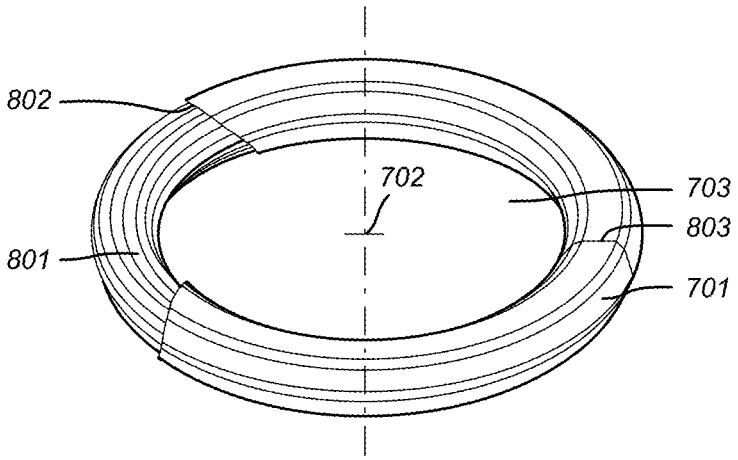
FIG. 8 shows a partially worked open view of an annular heat exchanger.

FIG. 8 shows a partially worked open drawing of the same vessel 701 as shown in FIG. 7. The chamber 802 of the shown vessel 701 has a toroid shape as described above. The drawing shows that the chamber 802 of the vessel 701 is densely packed with tubing 801. The tubing 801 is winded inside the chamber 802 around the above-mentioned axis 702.

FIG. 9 shows again the cross section corresponding to portion 803 of the vessel 701 as shown in FIGS. 7 and 8. Tubes 921 and 922 are for transport of refrigerant from the chamber 802 to the compressor 101 and for transport of refrigerant from the expansion valve 103, 104 into the chamber 802, respectively. As can be seen from the drawing, the chamber 802 of the heat exchanger is densely packed with tube windings 904. These windings may all belong to the same tube. Alternatively, a plurality of tubes exists inside the chamber 802, and each winding belongs to one of those tubes.

In a particular example, the dimensions of the arrangement of the chamber 802 and the tube windings 904 are as follows. The tube or tubes may have an inner diameter of 7 mm, an outer diameter of 8 mm, a wall thickness of 0.5 mm. A distance between any two adjacent tube windings may be 8.5 mm, measured from center axis to center axis of the tube. The distance from the tube to the vessel wall may be 0.5 mm. The number of windings may be 27.

Figure 10:
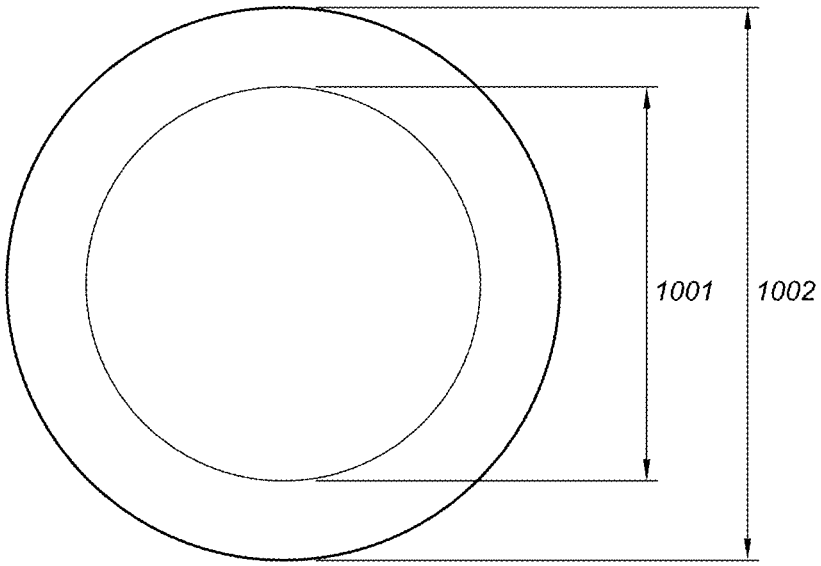
FIG. 10 shows a top view of the annular heat exchanger.
Figure 11:
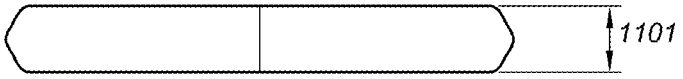
FIG. 11 shows a side view of the annular heat exchanger.

FIG. 10 illustrates a top view of the chamber, wherein the windings are not shown. FIG. 11 illustrates a side view of the chamber. An example of dimensions of the chamber is as follows. The smallest diameter 1001 of the chamber may be 292.65 mm, and the largest diameter 1002 of the chamber may be 407.35 mm. A measurement of this may be done with an accuracy of ±1 mm. A height 1101 of the chamber may be 52 mm.

For example, the tube enters and exits the chamber 802 through two orifices in the vessel wall. The orifices may enclose the tube such that no refrigerant can enter or leave the chamber through the orifice, and no fluids from exterior may enter through the orifice into the chamber. Further, the vessel wall has an inlet and an outlet connected to tubing 921, 922 to transport the refrigerant from the expansion device into the chamber 302 and from the chamber 802 into the compressor 101. The inlet is located at the bottom side of the chamber 802, or at least below a level of liquid refrigerant inside the chamber. However, the inlet may also be located above the level of liquid refrigerant in other embodiments. The outlet is located at the top side of the chamber 802, or at least above a level of liquid refrigerant inside the chamber. This way, no liquid refrigerant can reach the compressor.

As explained, the vessel can be used in a refrigeration cycle of a cooling system. The vessel in that state contains a refrigerant in the chamber, which refrigerant is circulated through the cooling cycle. Some of the refrigerant is in liquid state, another portion is in vapor state. The vessel has a chamber bounded by a surface of the vessel wall, the vessel comprising an inlet and an outlet for transport of refrigerant into and out of the chamber. The inlet can be anywhere; the outlet is preferably above the level of liquid refrigerant in certain embodiments. At least one tube is provided through which a liquid to be cooled is to flow in operation. At least one tube portion is inside the chamber, wherein a first end of the tube portion is fixed to a first orifice of the vessel and a second end of the tube portion is fixed to a second orifice of the vessel to enable fluid communication into and/or out of the tube portion through the first orifice and the second orifice. For example, the tube extends through the first orifice and/or second orifice. The first orifice and second orifice may be an orifice in the vessel wall and/or an orifice in a toroid shaped body which may enclose the vessel wall, as explained below. In the example shown in FIGS. 7 and 8, the chamber of the heat exchanger presents a hole 703. The tube portion inside the vessel is arranged in a plurality of windings around a wall portion of said vessel wall, which wall portion defines said hole. The hole 703 extends all the way through the vessel 701 and is defined by a wall portion of the vessel wall, so that fluids do not leak through the hole. The windings are arranged in a hexagonal tiling and form a bundle, with a space between each pair of adjacent windings. This hexagonal tiling can be best appreciated with reference to e.g. FIG. 9 which shows a cross section of the vessel at one side of the hole, as indicated in FIG. 8 at numeral 803. In other words, in a cross section perpendicular to the central axis of the tube windings or tube segments, the tubes are arranged on a hexagonal grid. The tubes may be fixed to one another to keep them in place. Also, the tubes may be supported by the structure that fills the portion of the vessel that is not taken up by the tube windings.

The surface 903 of the vessel wall is arranged with a space between the vessel wall and all of the windings 902 that are at an outside of the bundle. The windings which are at the outside of the bundle are those windings that are surrounded by less than six adjacent windings. For example, winding 905 is surrounded by six adjacent windings 906-911 and is not at the outside of the bundle. Winding 912 is surrounded by three adjacent windings 906, 913, 914, and winding 914 is surrounded by four adjacent windings 912, 906, 907, 915.

In the example shown in FIG. 9, the hexagonally tiled windings are arranged in rows, e.g. 916, 917, 918, etc., each row 918 consisting of a number of windings 914, 907, 908, etc., wherein the number of windings in any one row 917 differs with respect to each adjacent row 916 or 918 by one winding. When considering the successive rows 916, 917, 918, etc. in turn, the number of windings first increases from three windings to six windings and then decreases to four windings.

In an alternative embodiment, the number of windings in each row monotonically increases or monotonically decreases. For example, the number of windings in a row can increase from e.g. three (bottom row) to seven (top row). In another example, the number of windings in a row can decrease from e.g. seven (bottom row) to three (top row). The rows in a hexagonal tiling can be identified in three different directions, and the increase/decrease of the number of windings in each row applies to at least one of those directions.

Returning to FIG. 9, the pattern of increasing number of windings in each row is identical for all three directions in which the rows can be identified. This property is also helpful to keep the chamber small.

The chamber 802 and the surface of the vessel wall 903 has a shape of a toroid generated by a hexagon. This hexagon has rounded corners following a contour of the tube 902, 912. When the number of windings in each row is monotonic, the shape of the chamber and surface is the shape of a toroid generated by a quadrilateral, optionally with rounded corners.

The distance between a central axis of the tube in two adjacent windings 910, 911 multiplied by one half of the square root of three is smaller than an outer diameter (indicated d in FIG. 9) of the tube. Referring to FIG. 9, the distance between the central axis of the tube in two adjacent windings is equal to the sum of the space (indicated s in FIG. 9) in between a pair of adjacent tube segments and the outer diameter (indicated d in FIG. 9) of the tube portion. In a specific example, the distance between a central axis of the tube in two adjacent windings is 8.5 mm, the inner diameter of the tube is 7 mm, and the outer diameter of the tube is 8 mm. The spacing of the rows 416, 417, 418 is 7.4 mm in the example, which is smaller than the distance of 8.5 mm between the central axes of adjacent windings, which makes the design compact.

The distance from the inner surface 901 to a circumference 902 of a first portion of the tube adjacent to the inner surface 901 can be about equal to a distance between that circumference and a circumference 919 of a second portion of a winding of the tube adjacent to the first portion of the tube.

In a particular example of the heat exchanger the tube of the heat exchanger has an inner diameter of 7 mm, and the distance between the outlines of each pair of adjacent windings is between 0.2 and 0.8 mm.

Depending, among other parameters, on the dimensions of the heat exchanger, the heat exchanger can be used in conjunction with a variety of refrigerant materials, including Freon. In a particular example, the chamber comprises propane as the refrigerant. The dimensions described above are well suited for a cooling system based on propane as a refrigerant. Although certain dimensions have been disclosed above, the present disclosure is not limited thereto. The heat exchanger may be made with different dimensions.

Referring also to FIG. 1, any one, or both of the heat exchangers 105, 102 of the heat pump cycle may be filled at least partly, or entirely, with the structure 603. The structure used to fill the condenser 102 may be different from the structure used to fill the evaporator 105. These structures may differ with respect to the filling material 4 and/or the shape and dimensions of the channels 5. In a preferred embodiment, the evaporator 105 has the filling material, while the condensor 102 does not have the filling material.

Referring also to FIG. 1, the heat exchanger 300, comprising the structure 3, may be an evaporator 105 or a condenser 102 of a heat pump cycle.

In a particular embodiment, a heat pump comprises an evaporator comprising a chamber for a working fluid; and a wall for heat exchange between the working fluid in the chamber and a substance in a space on the opposite side of the wall, said chamber comprising a structure of a filling material that is substantially non-absorbent with respect to the working fluid, said structure defining a plurality of channels for the working fluid, said channels at least partly being bound by the wall separating the chamber from the space, said channels providing passage for the working fluid from an inlet of the chamber to an outlet of the chamber. In this embodiment, the heat pump further comprises a condensor comprising a second chamber for the working fluid, a second wall for heat exchange between the working fluid in the second chamber and a second substance in a second space on the opposite side of the second wall; said second chamber comprising a second structure of a second filling material that is substantially non-absorbent with respect to the working fluid, said second structure defining a plurality of second channels for the working fluid, said second channels at least partly being bound by the second wall separating the second chamber from the second space, said second channels providing passage for the working fluid from an inlet of the second chamber to an outlet of the second chamber.

When the heat pump is in operation, the compressor 101 pumps a working fluid (such as a refrigerant) though the condensor 102, then through the expansion valve 103, 104, and then though the evaporator 105 back to the compressor 101. When a part of the path of the working fluid (i.e. a chamber) is filled with the structure, the working fluid flows through channels of the structure, while interacting thermodynamically with a wall for heat exchange between the working fluid in the chamber and a substance in a space on the opposite side of the wall.

An embodiment comprises a method of heat exchange. The method comprises pumping a working fluid through channels of a chamber, causing the working fluid to interact thermodynamically with a wall for heat exchange between the working fluid in the chamber and a substance in a space on the opposite side of the wall, said chamber comprising a structure of a filling material that is substantially non-absorbent with respect to the working fluid, said structure defining a plurality of channels for the working fluid, said channels at least partly being bound by the wall separating the chamber from the space, wherein the working fluid flows from an inlet of the chamber to an outlet of the chamber through the channels.

The examples and embodiments described herein serve to illustrate rather than limit the invention. The person skilled in the art will be able to design alternative embodiments without departing from the spirit and scope of the present disclosure, as defined by the appended claims and their equivalents. Reference signs placed in parentheses in the claims shall not be interpreted to limit the scope of the claims. Items described as separate entities in the claims or the description may be implemented as a single hardware or software item combining the features of the items described.

The invention claimed is:

1. A heat exchanger for a heat pump, comprising
a chamber for a working fluid; and
a wall for heat exchange between the working fluid in the chamber and a substance in a space on the opposite side of the wall,
said chamber comprising a structure of a filling material that is substantially non-absorbent with respect to the working fluid,
said structure defining a plurality of channels for the working fluid, said channels at least partly being bound by the wall separating the chamber from the space,
said channels providing passage for the working fluid from an inlet of the chamber to an outlet of the chamber, and
wherein the structure is made up of a plurality of grains.

2. The heat exchanger of claim 1, wherein the channels of the structure do not have dead ends.

3. The heat exchanger of claim 1, wherein the material is substantially non absorbent with respect to oil.

4. The heat exchanger of claim 1, wherein the heat exchanger is an evaporator or a condenser.

5. The heat exchanger of claim 4, further comprising a compressor, an expansion valve, and the other of evaporator and condenser, to form a vapor-compression cycle.

6. The heat exchanger of claim 5, wherein said other of evaporator and condenser comprises:
a second chamber for the working fluid,
a second wall for heat exchange between the working fluid in the second chamber and a second substance in a second space on the opposite side of the second wall;
said second chamber comprising a second structure of a second filling material that is substantially non-absorbent with respect to the working fluid,
said second structure defining a plurality of second channels for the working fluid,
said second channels at least partly being bound by the second wall separating the second chamber from the second space,
said second channels providing passage for the working fluid from an inlet of the second chamber to an outlet of the second chamber.

7. A heat exchanger for a heat pump, comprising
a chamber for a working fluid; and
a wall for heat exchange between the working fluid in the chamber and a substance in a space on the opposite side of the wall,
said chamber comprising a structure of a filling material that is substantially non-absorbent with respect to the working fluid,
said structure defining a plurality of channels for the working fluid, said channels at least partly being bound by the wall separating the chamber from the space,
said channels providing passage for the working fluid from an inlet of the chamber to an outlet of the chamber,
wherein the material comprises sand or quartz or grit or a polymer or a thermoplastic polymer of the group: polyoxymethylene copolymer, POM-C, or a polyoxymethylene homopolymer, POM-H.

8. The heat exchanger of claim 7, wherein the material comprises polymer grains.

9. The heat exchanger of claim 7, wherein the material is substantially non absorbent with respect to oil.

10. The heat exchanger of claim 7, wherein the heat exchanger is an evaporator or a condenser.

11. A heat exchanger for a heat pump, comprising
a chamber for a working fluid; and
a wall for heat exchange between the working fluid in the chamber and a substance in a space on the opposite side of the wall,
said chamber comprising a structure of a filling material that is substantially non-absorbent with respect to the working fluid,
said structure defining a plurality of channels for the working fluid, said channels at least partly being bound by the wall separating the chamber from the space, said channels providing passage for the working fluid from an inlet of the chamber to an outlet of the chamber, wherein the structure is made up of a plurality of grains wherein the maximum distance between adjacent channels of the structure is between 0.3 millimeter and 1 millimeter, or the grains have an average diameter of between 0.3 millimeter and 1 millimeter, or the channels have a diameter of generally less than 1 millimeter in cross-section.

12. The heat exchanger of claim 11, wherein the filling material fills up between 30% and 70% of the volume of the chamber.

13. The heat exchanger of claim 11, wherein the heat exchanger is an evaporator or a condenser.

14. A heat exchanger for a heat pump, comprising a chamber for a working fluid; and a wall for heat exchange between the working fluid in the chamber and a substance in a space on the opposite side of the wall, said chamber comprising a structure of a filling material that is substantially non-absorbent with respect to the working fluid, said structure defining a plurality of channels for the working fluid, said channels at least being partly bound by the wall separating the chamber from the space, said channels providing passage for the working fluid from an inlet of the chamber to an outlet of the chamber, the heat exchanger further comprising a vessel for containing the working fluid, the vessel forming the chamber, wherein the chamber is bounded by a surface of a vessel wall and a wall of at least one tube, the vessel comprising an inlet and an outlet for transport of the working fluid into and out of the chamber;

said at least one tube forming the space for the substance, of which at least one tube portion is inside the vessel, wherein a first end of the tube portion is fixed to a first orifice of the vessel and a second end of the tube portion is fixed to a second orifice of the vessel to enable fluid communication into and/or out of the tube portion through the first orifice and the second orifice;

wherein the chamber outside said at least one tube is filled with the structure;

wherein the at least one tube portion has an outer surface in contact with the structure;

wherein the at least one tube portion is arranged in a plurality of windings around a wall portion of said vessel wall and around a region external to the chamber.

* * * * *